United States Patent [19]

Abel et al.

[11] 4,443,960

[45] Apr. 24, 1984

[54] FRAME STRAIGHTENING AND SUPPORTING DEVICE

[76] Inventors: Jack Abel, 16-24 202 St., Bayside, N.Y. 11360; Cora Abel, 12 Lee St., Cambridge, Mass. 02139

[21] Appl. No.: 416,716

[22] Filed: Sep. 13, 1982

Related U.S. Application Data

[62] Division of Ser. No. 184,521, Sep. 5, 1980, Pat. No. 4,373,279.

[51] Int. Cl.[3] ..... G09F 1/12

[52] U.S. Cl. ..... 40/152.1; 40/155; 248/488

[58] Field of Search ..... 40/152, 152.1, 155; 248/488, 490

[56] References Cited

U.S. PATENT DOCUMENTS

| | | | |
|---|---|---|---|
| 236,845 | 1/1881 | Scheurich | 40/152.1 |
| 445,305 | 1/1891 | Tidball | 40/152.1 |
| 1,846,988 | 2/1932 | Buck | 40/603 |
| 3,823,499 | 7/1974 | Gilbert | 40/155 |
| 4,373,279 | 2/1983 | Abel et al. | 40/155 |

*Primary Examiner*—Gene Mancene
*Assistant Examiner*—Wenceslao J. Contreras
*Attorney, Agent, or Firm*—Albert F. Kronman

[57] ABSTRACT

A framing device which includes a plurality of adjustable arms to tension the frame by pressing against the inner surfaces at each of the corner points and with each arm also being adjustable about a transverse plane.

4 Claims, 3 Drawing Figures

FRAME STRAIGHTENING AND SUPPORTING DEVICE

BACKGROUND OF THE INVENTION

This application is a division of an application for patent entitled Frame Straightening Device Ser. No. 184,521, filed Sept. 5, 1980, now U.S. Pat. No. 4,373,279.

Conventional oil paintings done on canvas and a wide variety of graphic art displays are commonly mounted in or stretched over wooden frames. Although the wood is frequently dried and assembled so as to prevent the frame from warping, improper construction and neglect of frames often causes them to become distorted. Once a frame starts to warp, it is difficult to restore it to its proper shape. Where the frame distorts the original flat shape of an old canvas or other brittle backing, forcing the work back suddenly into its original shape will sometimes crack the paint or tear the surface of the display.

Accordingly, it is an object of the present invention to overcome the difficulties of conventional picture frames by providing a support to hold them and to prevent them from warping.

A further object of the present invention is to provide a way of straightening a frame over a period of time by applying slow, even pressure to its warped portion—thereby correcting the warp without damaging the artwork.

Still another object of the present invention is to provide a device for holding or straightening a circular, irregularly shaped or multisided frame.

Still another object of the invention is to provide a structure for supporting and straightening frames that may be adjusted to fit frames of different shapes and sizes.

SUMMARY OF THE INVENTION

A frame straightening and support device made according to the present invention comprises a rigid central plate to which are connected a plurality of outwardly extending arms. These arms are fastened to the plate and provided with telescoping portions ending in brackets to engage a wide variety of frame shapes or other structures to be straightened or supported. Adjusting screws and a fulcrum, may be used to adapt the support to non-planar frames to reinforce them or to bring them back to a planar surface.

DESCRIPTION OF DRAWINGS

In the accompanying drawings forming a part hereof, similar parts have been given identical reference numbers, in which drawings.

DESCRIPTION OF THE PREFERRED EMBODIMENTS

Figure 1:
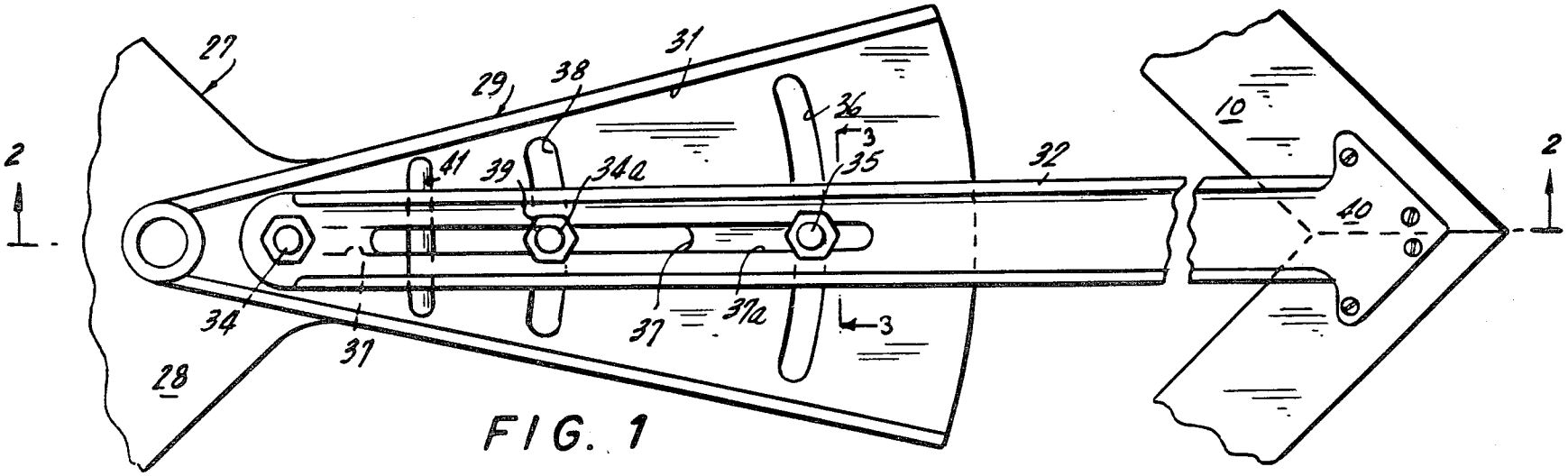
FIG. 1 is a fragmentary plan view of an outwardly extending arm assembly, an embodiment of the present invention.
Figure 2:
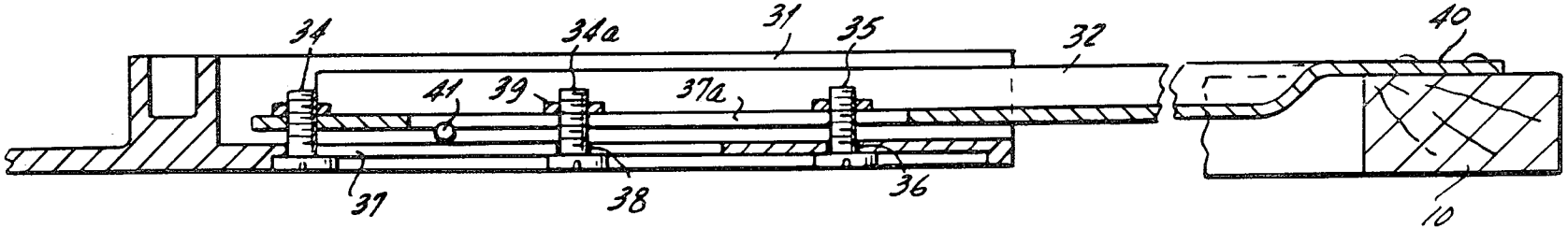
FIG. 2 is a longitudinal cross-sectional view taken along the line 2—2 in FIG. 1, looking in the direction of the arrows.
Figure 3:
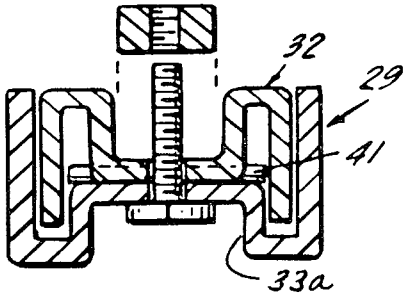
FIG. 3 is a cross-sectional view taken along line 3—3 of FIG. 1 looking in the direction of the arrows.

Referring to the drawings and FIGS. 1-3 in particular, 10 indicates a picture frame fitted with a frame straightening and supporting device 27 made in accordance with the present invention.

A central plate 28, made of some suitable rigid material is provided with inner arm segments 29 which are somewhat wedge shaped and may be either rigidly secured to the central plate 28 or pivotally secured. The inner arm segment 29 is provided with diverging upstanding sidewalls 31 between which there is received an outer segment 32.

The bottom 33*a* of the inner segment 29 may be flat as indicated in FIGS. 1 and 2 or recessed for greater strength as shown in FIG. 3. In both cases, the outer segment 32 is secured to the bottom of the inner segment by means of through bolts 34, 34*a* which are slipped through an elongated slot 37 in the bottom 33*a*. The fastening pin 35 carried within an arcuate slot 36 in the bottom of the inner segment 29 extends upwardly through an elongated opening 37*a* in the outer segment 32. The fastening pin 35 is free to move along the arcuate slot 36 and the outer segment 32 is longitudinally moveable along the pin 35 by reason of the slot 37*a*. The pin 35 thus serves as a guide for the outer segment 32.

A second arcuate slot 38 is formed in the bottom of the inner arm segment 29 inwardly spaced from the first arcuate slot 36. The through bolt 34*a* extends through the elongated slots 37, 37*a* of the inner and arm segments 29 and 32 and rides within the second arcuate slot 38. The through bolt 34*a* thus also serves to guide and support the outer arm segment 32. Through bolt 34 serves as a pivot point for the inner end of the outer arm segment 32.

It will be seen from an examination of FIG. 1 that by loosening through bolt 34*a* as by turning nut 39, it is possible to swing the outer arm segment 32 through an arc limited by the upstanding sidewalls 31 of the inner arm segment 29. A short fulcrum 41 carried across the bottom of the inner arm segment serves as a bearing point against which the outer arm segment can be secured by tightening the through bolts 34,34*a*. In this manner the position of the bracket 40 at the end of the outer arm segment 32 can be adjusted to the desired location on the frame 10.

By sliding the outer arm segment 32 along the elongated opening 37, it is possible to adjust the frame straightener to the size and shape of the frame.

Having thus fully described the invention, what is claimed as new and desired to be secured by Letters Patent of the United States, is:

1. A frame supporting and tightening device comprising a rigid central plate disposed parallel to the plane of the frame, a plurality of adjustable longitudinally slidable and angularly displacable segmented arms secured at one end to the central plate and extending outwardly thereof, said segmented arms comprising a substantially wedge shaped inner segment and an outer segment slidably carried by each of the inner segments and swingable therein, pivot means including spaced adjusting screws carried by the outer arm segment to adjustably secure the segments together, at least one bracket secured at the free end of each of the segmented arms and means to vary the angular position of the arm segments with respect to each other and the central plate to apply a desired force to portions of the frame.

2. A device according to claim 1 in which the pivotal mounting comprises a transverse pin carried by upstanding wall portions in the arm segments.

3. A device according to claim 2 in which the inner arm segment is provided with spaced parallel arcuate slots and at least one through bolt receivable within the slots for lateral adjustment of the outer segment with respect to the inner segment.

4. A device according to claim 3 in which a transverse fulcrum pin is disposed between the inner and outer arm segments and between a first and a second through bolt for angular adjustment of the arm segments.

* * * * *